US007270223B2

(12) United States Patent
Miller

(10) Patent No.: US 7,270,223 B2
(45) Date of Patent: Sep. 18, 2007

(54) LUGGAGE HANDLE SYSTEM WITH PIVOT GRIP

(75) Inventor: Jacqueline N. Miller, Boca Raton, FL (US)

(73) Assignee: Travelpro International, Inc., Boca Raton, FL (US)

( * ) Notice: Subject to any disclaimer, the term of this patent is extended or adjusted under 35 U.S.C. 154(b) by 366 days.

(21) Appl. No.: 10/964,186

(22) Filed: Oct. 13, 2004

(65) Prior Publication Data

US 2006/0076203 A1 Apr. 13, 2006

(51) Int. Cl.
*A45C 13/26* (2006.01)
*A45C 5/14* (2006.01)

(52) U.S. Cl. ..... 190/115; 190/18 A; 190/39; 16/113.1; 16/114.1

(58) Field of Classification Search ..... 190/39, 190/115; 16/113.1, 408, 409, 114.1; 403/114
See application file for complete search history.

(56) References Cited

U.S. PATENT DOCUMENTS 3,081,114 A * 3/1963 Esty ..... 403/71
4,159,832 A * 7/1979 Inbody ..... 280/124.126
5,265,307 A 11/1993 Hull et al.
5,269,045 A 12/1993 Deserio et al.
5,339,934 A 8/1994 Liang
5,464,080 A 11/1995 Liang
5,547,053 A 8/1996 Liang
6,332,242 B1 * 12/2001 Chen ..... 16/113.1
6,434,790 B1 8/2002 Chen
6,470,533 B1 10/2002 Comstock
6,508,344 B1 * 1/2003 Lu ..... 190/115
6,651,791 B1 11/2003 Nykoluk et al.
D486,648 S 2/2004 Fenton
6,892,866 B2 * 5/2005 Wu ..... 190/115
2002/0144874 A1 10/2002 Nykoluk et al.
2002/0184736 A1 12/2002 Nelson
2003/0085089 A1 * 5/2003 Lin et al. ..... 190/115
2003/0132079 A1 * 7/2003 Bellini ..... 190/115
2003/0192146 A1 * 10/2003 Chang ..... 16/113.1
2004/0238304 A1 * 12/2004 Fisher ..... 190/115
2005/0011043 A1 * 1/2005 Comstock ..... 16/114.1
2005/0150732 A1 * 7/2005 Costa et al. ..... 190/115

* cited by examiner

*Primary Examiner*—Sue A. Weaver
(74) *Attorney, Agent, or Firm*—Sacco & Associates

(57) ABSTRACT

A handle system for a rolling luggage case can include a luggage case in which one or more articles can be stored and having a top, bottom, front, and back panels, and a pair of sidewalls. The luggage case can include a wheel assembly provided at a location on the bottom panel and adjacent to the back panel; at least one telescoping member that is extensible from a retracted position within the luggage case to an extended position protruding from the luggage case; and a gear assembly that is attached to an end of the telescoping member(s) that is distal from the luggage case. The handle system can include a handle attached to the telescoping member(s) through the gear assembly. The gear assembly can provide pivotal and rotational movement of the handle about the end of the telescoping member(s).

19 Claims, 5 Drawing Sheets

LUGGAGE HANDLE SYSTEM WITH PIVOT GRIP

BACKGROUND OF THE INVENTION

1. Statement of the Technical Field

The invention generally concerns rolling luggage and, more particularly, a handle system for rolling luggage.

2. Description of the Related Art

Rolling luggage has become increasingly popular in recent years. A common configuration for this type of luggage includes a container or case portion that is generally rectangular in shape in which one or more articles can be stored for travel. The container typically has a top, bottom, front and back panels, and a pair of sidewalls. A wheel assembly is commonly provided to allow the container to be rolled rather than carried. The wheel assembly generally includes a pair of wheels mounted at an interface of the bottom panel and the back panel of the luggage. The orientation of the wheels defines a rolling direction for the luggage that is orthogonal to the axis of rotation for the wheels.

A telescoping handle assembly is generally provided which is attached to the back panel and the bottom of the case. The telescoping handle assembly typically includes two telescoping posts that extend from the top panel of the container. A cross-member is generally provided at an end of the telescoping post assembly distal from the container and aligned in a plane that is roughly parallel to the back panel. Configured in this way, the handle assembly provides a gripping surface that is generally oriented transverse to the rolling direction and can therefore be uncomfortable to grip for extended periods of time.

One proposed solution for providing a more comfortable gripping surface has been to mount a handle atop of the cross-member. The handle assembly is allowed rotate about the cross-member. Such a handle configuration allows users to grasp the handle in a more natural fashion where the handle rotates as the user maneuvers with the rolling luggage.

Another proposed solution has been to allow the handle to pivot with respect to the telescoping tubes. That is, the handle is not restricted to extending from the telescoping tubes in a linear fashion. Instead, a pivotal joint is included which allows the handle to pivot with respect to the telescoping tube. Accordingly, an obtuse angle can be formed where one leg of the angle is formed by the handle and the other leg of the angle is formed by the telescoping tubes.

Typically, only one of these solutions is implemented in any given piece of rolling luggage. Rolling luggage that does provide both rotational and pivotal motion for the handle, however, often includes two separate and distinct mechanisms. One mechanism within the handle provides rotational movement. The other mechanism provides pivotal movement. While such handle systems do provide increased comfort and ease of use for users, the inclusion of two separate mechanisms for operation of the handle can unduly complicate the rolling luggage design and add unnecessary cost.

SUMMARY OF THE INVENTION

One aspect of the present invention can include a handle system for a rolling luggage case. The handle system can include a luggage case in which one or more articles can be stored for travel. The luggage case can contain a top, bottom, front, and back panels, and a pair of sidewalls. Also included can be a wheel assembly provided at a location on the bottom panel and adjacent to the back panel, and at least one telescoping member that is extensible from a retracted position within the luggage case to an extended position protruding from the luggage case. The handle system further can include a gear assembly attached to an end of the telescoping member(s) that is distal from the luggage case. The gear assembly can provide pivotal and rotational movement about the end of the telescoping member(s). A handle also can be included. The handle can be attached to the telescoping member(s) through the gear assembly. The handle can be rotatable and pivotal about the end of the telescoping member(s).

The gear assembly can include a gear housing having a gear disposed therein. The gear can pivot within the gear housing. The gear housing can include a cylindrical portion, a domed portion, and a bore extending through a length of the gear housing. The domed portion can include a slot through which a stem of the gear extends. The gear can have a rounded base with two substantially flat portions which can engage substantially flat inner walls of the bore of the gear housing thereby facilitating pivotal movement of the gear in a plane that is substantially parallel with the substantially flat portions of the gear. A contour of the slot of the domed portion of the gear housing can serve to limit the pivotal movement of the gear in at least one direction.

The handle can include a push button plate having a ridge. The stem of the gear can include a plurality of slots joined by a channel that is substantially perpendicular to the plurality of slots. The ridge can ride within the plurality of slots and the channel thereby facilitating rotational motion of the handle. The plurality of slots can include a middle slot and two outer slots. Each outer slot can be separated from the middle slot by about 90 degrees around a circumference of the stem. Accordingly, the handle can rotate approximately 90 degrees in either a clockwise or a counterclockwise direction about the distal end of the telescoping member(s) according to positions of the outer slots with respect to the middle slot.

The handle can pivot to form an angle defined by a first axis generally aligned with the telescoping member(s) and a second axis through a center of the handle, such that the angle is within a range of approximately 0-45 degrees. The rounded base of the gear can include an aperture for receiving at least an end portion of a main spring. An opposite portion of the main spring can be cooperatively engaged by a spring housing disposed within the telescoping member(s). The handle system further can include a push button housing having an aperture for receiving the stem. The gear can include a groove located between the stem and the rounded base, such that the gear can be secured within the push button housing by at least one pin that is approximately orthogonal to an orientation of the stem and which engages the groove.

In another embodiment of the present invention, a handle system for an article of rolling luggage can include a luggage case in which one or more articles can be stored for travel, a wheel assembly provided at a location on the bottom panel and adjacent to the back panel, and one or more telescoping members. The luggage case can include a top, bottom, front, and back panels, and a pair of sidewalls. The telescoping member(s) can be mounted adjacent to the back panel, and extensible from a retracted position within the luggage case to an extended position protruding from the luggage case.

The handle system further can include a handle secured to the telescoping member(s) by a gear assembly that provides a limited range of movement of the handle relative to the telescoping member(s). The movement can include: (1) rotational movement of the handle about a first axis generally aligned with the telescoping member(s); and (2) pivotal movement of the handle defined by variation in a handle angle formed between the first axis and a second axis through a center of the handle that is substantially perpendicular to a gripping surface of the handle. The handle angle can range from about 0 to 45 degrees.

The gear assembly can include a gear housing having a gear disposed therein. The gear can pivot within the gear housing. The gear housing further can include a cylindrical portion, a domed portion, and a bore extending through a length of the gear housing. The domed portion can include a slot through which a stem of the gear extends. The gear can include a rounded base with two substantially flat portions. The substantially flat portions can engage substantially flat inner walls of the bore of the gear housing thereby facilitating pivotal movement of the gear in a plane that is substantially parallel with the substantially flat portions of the gear. A contour of the slot of the domed portion of the gear housing can limit the pivotal movement of the gear in at least one direction.

The handle can include a push button plate having a ridge. The stem of the gear can include a plurality of slots joined by a channel that is substantially perpendicular to the plurality of slots. The ridge can ride within the plurality of slots and the channel thereby facilitating rotational motion of the handle. The plurality of slots can include a middle slot and two outer slots. Each outer slot can be separated from the middle slot by about 90 degrees around a circumference of the stem. The handle can rotate approximately 90 degrees in either a clockwise or a counter-clockwise direction about the end of the telescoping member(s) according to positions of the outer slots with respect to the middle slot.

The rounded base of the gear has an aperture for receiving at least an end portion of a main spring, wherein an opposite portion of the main spring is cooperatively engaged by a spring housing disposed within the telescoping member(s). The handle system further can include a push button housing having an aperture for receiving the stem. The gear can include a groove located between the stem and the rounded base. The gear can be secured within the push button housing by at least one pin that is approximately orthogonal to an orientation of the stem and which engages the groove.

DETAILED DESCRIPTION OF THE PREFERRED EMBODIMENTS

The present invention relates to a handle system for use with rolling luggage. The various embodiments of the handle system disclosed herein provide users with the ability to ergonomically grip the handle during use. This reduces the strain placed on the user's hand, wrist, and arm. Further, users can more easily maneuver the rolling luggage and navigate walkways when traveling.

Figure 1:
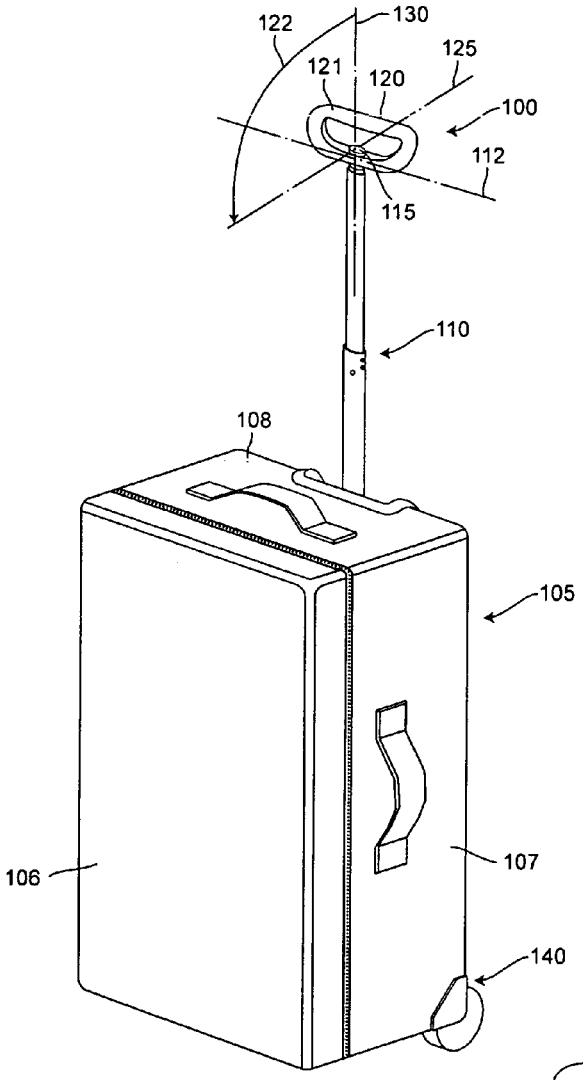
FIG. 1 is a perspective view of an adjustable handle system attached to an article of rolling luggage in accordance with the inventive arrangements disclosed herein.

FIG. 1 is a perspective view of an adjustable handle system 100 attached to a luggage case 105 in accordance with the inventive arrangements disclosed herein. In one embodiment of the present invention, the handle system 100 can include a single telescoping member 110 and a handle 120. The telescoping member 110 can be a post that is extensible from a retracted position within the luggage case 105 to an extended position protruding from the luggage case 105 as shown.

The luggage case 105 has a top 108, bottom, front 106 and back panels, and a pair of sidewalls 107. Notably, the bottom and back panels, as well as one of the side walls are obstructed from view. A wheel assembly 140 is provided to allow the luggage case 105 to be rolled rather than carried. The wheel assembly 140 generally includes a pair of wheels mounted at an interface of the bottom panel and the back panel of the luggage case 105. The orientation of the wheels defines a rolling direction for the article of rolling luggage that is orthogonal to the axis of rotation for the wheels.

In one embodiment, the handle 120 can be a closed form that is substantially rectangular in shape, but having rounded corners. It should be appreciated, however, that any of a variety of different shapes can be used for the handle 120, so long as such shapes facilitate ergonomic and comfortable gripping of the handle 120 by a user. For instance, oblong circular shapes also can be used, though such shapes may not provide the level of comfort attainable by the form of handle 120 shown in FIG. 1.

The handle 120 can include a button 115, which can be used to facilitate actions relating to the telescoping member 110 and the handle system 100. More particularly, activation of button 115 can facilitate actions such as extending and retracting the telescoping member 110 and releasing or engaging the handle 120 to facilitate rotational motion and/or pivotal motion about the telescoping member 110.

The telescoping member 110 can define a first axis 130 that is generally aligned with the telescoping member 110. Handle 120 can include at least one gripping surface 121. The gripping surface 121 can be provided along a second axis 112 such that it is substantially perpendicular to the first axis 130. Axis 125 also is substantially perpendicular to axis 130, and when taken together with axis 112, forms plane that is about parallel with top 108.

The handle 120 can be secured to the telescoping member 110 by a gear assembly that facilitates various types of movement of the handle 120 relative to the telescoping member 110. According to one embodiment of the invention, the gear assembly can facilitate two basic types of movement of the handle 120. These two types of movement can include (1) rotational movement of the handle 120 about the first axis 130, and (2) pivotal movement of the handle relative to the axis 130. The pivotal movement can be any movement that results in variation of a handle angle formed between the first axis 130 and an axis through a center of the handle 120 that is substantially perpendicular with the gripping surface 121, in the general direction of arrow 122. The combination of rotational movement and pivotal movement can provide a more comfortable position for a person to grasp the gripping surface 121. Notably, when the handle 120 is in a position that has not been pivoted, as shown in FIG. 1, the handle angle is about 0° as the axis through the center of handle 120 and axis 130 are substantially aligned.

Figure 2:
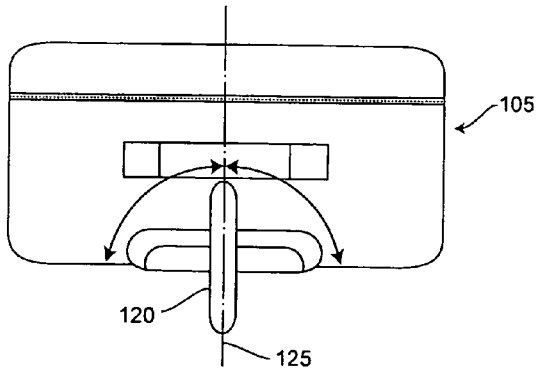
FIG. 2 is a top view of the article of rolling luggage illustrating rotational motion of the handle in accordance with one aspect of the inventive arrangements disclosed herein.

FIG. 2 is a top view of the article of rolling luggage illustrating rotational motion of the handle 120 in accordance with one aspect of the inventive arrangements disclosed herein. As shown, the handle 120 has been fully extended from the luggage case 105. The handle 120 has been rotated approximately 90° with respect to the telescoping member and luggage case 105. The handle 120 can be rotated from its original position in either a clockwise or counter-clockwise direction to a final position that is substantially parallel to axis 125, which is substantially parallel to the line of motion for the luggage case 105.

Figure 3C:
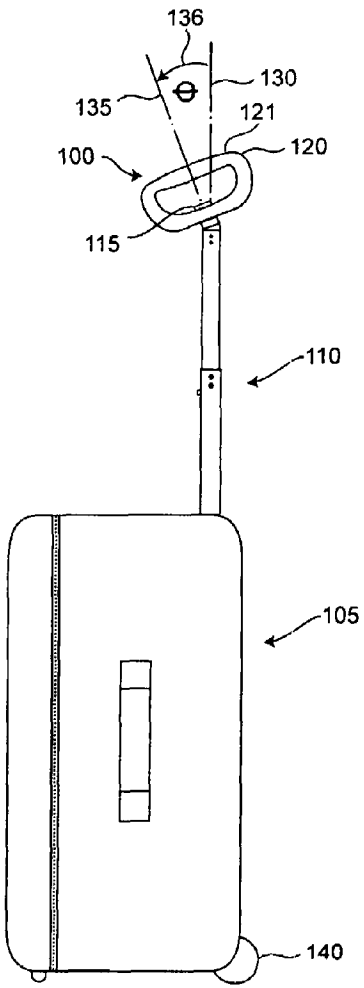
FIGS. 3A-3C are a series of views illustrating various movements of the handle system in accordance with the inventive arrangements disclosed herein.
Figure 3B:
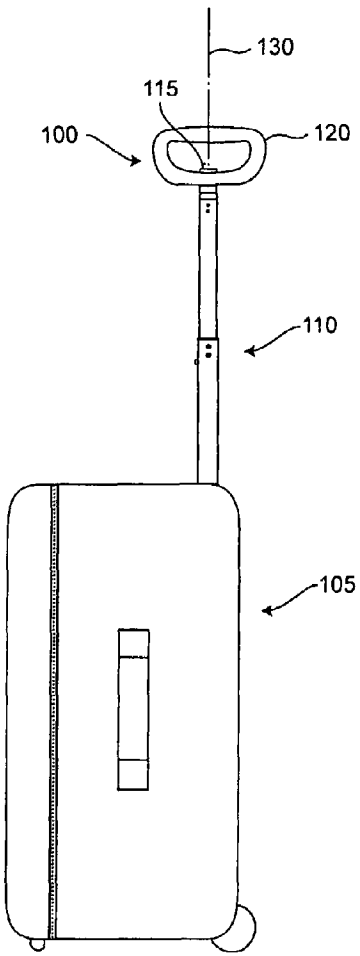
Figure 3A:
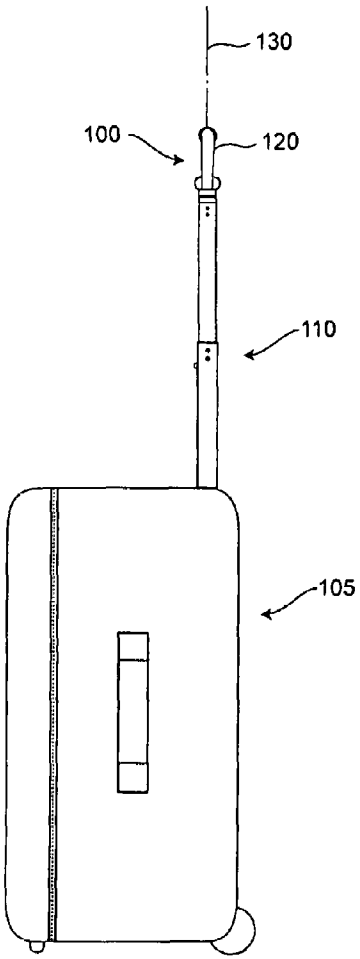

FIGS. 3A-3C are a series of views illustrating positions in which the handle 120 can be disposed in relation to the telescoping member 110 and luggage case 105 in accordance with the inventive arrangements disclosed herein. FIG. 3A illustrates the case where the telescoping member 110 has been fully extended and locked into position. In FIG. 3B, button 115 of the handle assembly 110 has been depressed and the handle 120 has been rotated approximately 90 degrees from its original position shown in FIG. 3A. As noted, the handle 120 can be rotated in a clockwise or counter-clockwise direction. Still, axis 130, which is generally aligned with the telescoping member 110, is also generally aligned with the axis through the center of the handle 120. That is, the handle 120, though rotated, has not been pivoted.

In FIG. 3C, the handle 120 has been pivoted to a handle angle θ determined by the axis 135 running through the center of handle 120 and axis 130, which is generally aligned with the telescoping member 110. Thus, axis 135, as can be seen in FIG. 3C, is generally perpendicular to the gripping surface 121. Axis 135 further runs through a center of the gripping surface 121 and the button 115. In one embodiment, handle angle θ can be defined by the relationship $0° \leqq \theta \leqq 45°$. As such, the value of the handle angle θ can be any value within the defined range. It should be appreciated, however, that the possible range of θ can vary. For example, other ranges can include, but are not limited to, $0° \leqq \theta \leqq 25°$; $0 \leqq \theta \leqq 30°$; $0° \leqq \theta \leqq 35°$, $0° \leqq \theta \leqq 40°$; or $0° \leqq \theta \leqq 50°$. It further should be appreciated that the values noted herein can be approximate values and need not be exact angle measurements.

The pivotal movement of handle 120 can be said to be in a counter-clockwise direction as measured from axis 130. Notably, despite the direction in which the handle 120 is rotated about the telescoping member 110, i.e. clockwise or counter-clockwise, the pivotal movement of the handle 120 is always in the direction of arrow 136 away from axis 130. This facilitates comfortable gripping on the part of a user. It should be appreciated, however, that handle 120 can be pivoted some handle angle θ whether or not the handle 120 has been rotated. Such pivotal movement can occur generally in the direction of arrow 136.

Figure 4:
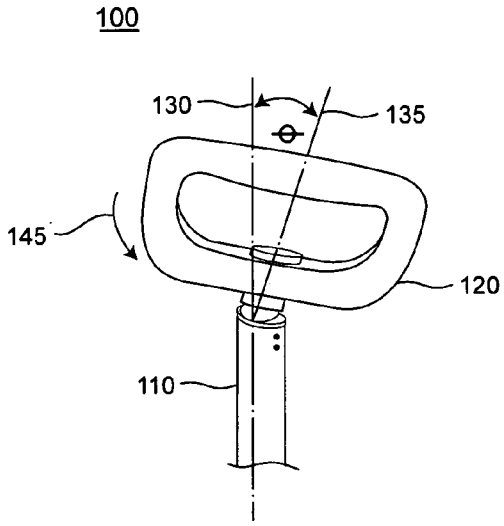
FIG. 4 is a perspective view of the handle system in accordance with the inventive arrangements disclosed herein.

FIG. 4 is a perspective view of the handle system 100 in accordance with the inventive arrangements disclosed herein. In FIG. 4, the handle 120 has been rotated some distance 145 about the telescoping member 110. As noted, this distance can be about 90° from the original orientation of the handle 120. The handle 120 also has been pivoted a handle angle θ as shown and defined by axes 130 and 135.

Figure 5A:
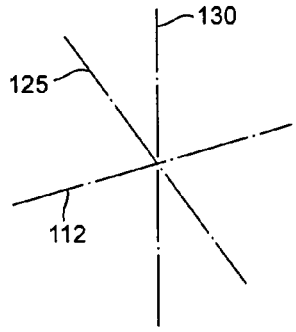
FIG. 5A is an exploded view of the handle system in accordance with one embodiment of the present invention.
Figure 5A:
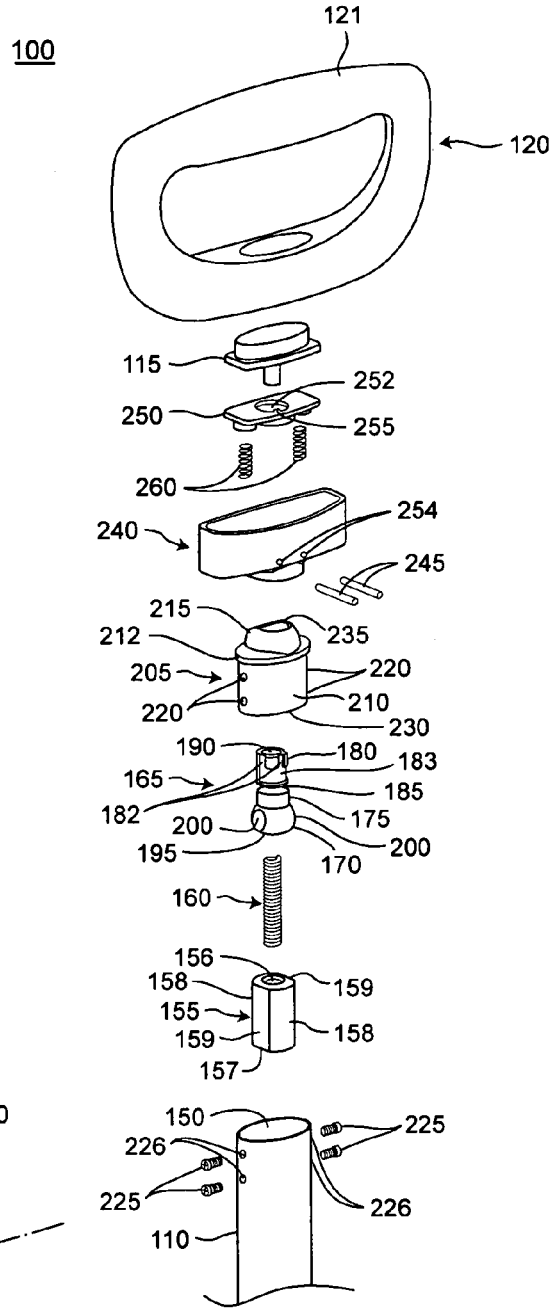

FIG. 5A is an exploded view of the handle system 100 in accordance with one embodiment of the present invention. The telescoping member 110 includes an end that is distal from the luggage case 105 (not shown) when in a fully extended position. The telescoping member 110 is hollow such that the distal end has an aperture 150 capable of receiving a spring housing 155, a main spring 160, a gear 165, and a portion of a gear housing 205 therein. The gear 165 and the gear housing 205 can comprise the gear assembly.

The spring housing 155 is generally an oblong-cylindrical shape, having two rounded surfaces 158 and two substantially flat surfaces 159. The spring housing 155 has a top bore 156 and a bottom bore 157, each circular in shape. Neither bore extends more than partially through the length of the spring housing 155, such that the two bores 156 and 157 do not join. A portion of the main spring 160 is received by the top bore 156 of the spring housing 155. The bottom bore 157 receives a rod (not shown) which aids in locking and unlocking the telescoping action of telescoping member 110.

The gear 165 is formed of a gear base 170 that is generally spherical in shape, a gear middle 175 that is cylindrical in shape, and a stem 180 above the gear middle 175. The gear 165 further has a groove 185 or channel between the gear middle 175 and the stem 180. The groove 185 has a diameter that is less than the gear middle 175, the stem 180, and the gear base 170.

The gear 165 is hollow having a bore or shaft running completely through its length and terminating in top aperture 190 and bottom aperture 195. The top portion of spring 160 is received by the bottom aperture 195. With this configuration, the spring 160 provides enough rigidity such that the handle 120, when left untouched, remains in an upright and non-pivoted position that is generally aligned with the telescoping member 110. The gear base 170 of the gear 165 has two substantially flat surfaces 200 which allow pivotal motion generally in a single plane defined by axes 125 and 130.

The stem 180 includes a plurality of slots 182 that are oriented along the length of the gear 165, i.e. generally aligned with axis 130. According to one embodiment, three slots are included. A first slot, the middle of the three, is used to lock the handle 120 in its original position generally aligned with axis 112. The other two slots are located on either side of the middle slot and are separated from the middle slot by approximately 90°. Thus, the slots 182 of the stem 180 surround approximately half of the circumference of the stem 180. Each of the outer slots provides the locking capability when rotating the handle by 90° in either the clockwise or counter-clockwise direction, thereby allowing the handle 120 to rotate such that gripping surface 121 is generally aligned with axis 125.

The slots are separated by raised portions, similar to teeth of a gear. These teeth do not run the entire length of the stem 180. Rather, approximately halfway down the stem 180, the three slots 182 are joined by a channel 183 running perpendicular to the slots. The channel 183 runs only one half of the circumference of the stem 180, joining all three slots 182 as the two outer slots are about 180° apart. A ridge 255 of a push button plate 250 can travel in the slots 182. For example, when the handle 120 is in the original position, push button 115 can be depressed, thereby causing the ridge 255 to travel down the middle slot and into the channel 183 of the stem 180. Once in the channel 183, the handle 120 can be rotated. The push button 115 can be released when the handle 120 has been rotated approximately 90° in either the clockwise or counter-clockwise direction. When the push button 115 is released, the ridge 255 can travel up one of the outer slots that is offset from the original slot by 90°. The ridge 255 traveling within the slots 182 and the channel 183 limits the rotational motion of the handle 120 and provides the locking action.

The gear housing 205 receives and secures the gear 165. The gear housing 205 includes a cylindrical portion 210 that is oval in shape to fit snuggly with aperture 150 of the telescoping member 110. The gear housing 205 also includes a collar 215. The cylindrical portion 210 of the gear housing 205 can be separated from the collar 215 by a collar ridge 212. The cylindrical portion 210 has four bores 220 for receiving screws 225 when the gear housing 205 is disposed within the telescoping member 110. The screws 225 are secured through apertures 226 and into bores 220. Bores 220 can be threaded thereby allowing the screws 225 to securely engage the gear housing 205. This secures the entire gear housing 205 and components located therein within the telescoping member 110.

The gear housing 205 has a bore running completely through terminating at the bottom with a bottom aperture 230 and terminating at the top with a top slot 235. The bottom portion of the bore near aperture 230 is shaped to receive the spring housing 155. That is, the bottom aperture 230 has two rounded portions and two flattened portions. The bore can narrow toward the top slot 235 such that the top slot 235 in the collar 215 is narrower than the bottom aperture 230. The top slot 235, however, is large enough to allow the stem 180 of the gear 165 to extend through, but prevents the gear base 170 from passing.

When the gear 165 is inserted through the bottom aperture 230, the spherical gear base 170 fits such that the rounded, or spherical portions, fit against the curved portions of the gear housing bore and the substantially flat portions 200 fit against the substantially flat walls of the gear housing bore. This allows the gear 165 to pivot generally in a plane that is parallel to the planes defined by the substantially flat portions 200 of the gear base 170, i.e. in a plane defined by axes 125 and 130.

A push button housing 240 rests atop of the gear housing 205. The push button housing 240 is trough-like having an aperture (not shown) in the bottom for receiving the stem 180. When the gear 165 is inserted into the gear housing 205, the stem 180 extends through the top slot 235 of the gear housing 205 past the collar 215 and into the push button housing 240 through its bottom. Pins 245 can be inserted through apertures 254 in the push button housing 240. The pins 245 run within the groove 185 of the gear 165, thereby securing the gear 165 within the gear housing 205, and the gear housing 205 beneath the push button housing 240. Notably, pins 245 can extend completely through the push button housing 240 to apertures on the backside of push button housing 240 which are obstructed from view. These apertures can be opposite of apertures 254.

The push button 115 rests atop of the push button plate 250. The push button plate 250 has an aperture 252 for receiving the stem 180 of the gear 165. The edge of the push button plate 250 forming the aperture 252 defines the ridge 255 which rides within the slots 182 and the channel 183 connecting the three slots 182. Springs 260 ensure that the push button 115 returns to its original position after actuation. When the push button 115 is in its resting position, ridge 255 is located at the top of one of the slots 182. The particular slot within which the ridge 255 is located depends upon the rotation of the handle 120. The handle 120 has a cavity for receiving the push button 115, the push button plate 250, and the push button housing 240. Screws (not shown) or other fasteners can be used to secure the handle 120 to the push button housing 240.

In operation, engaging the push button 115 causes the push button plate 250 to be pushed to the bottom portion of the stem 180. The ridge 255 rides through the middle slot in the stem 180 until the ridge 255 enters the channel 183 linking all three slots 182 of the stem 180. Once the ridge 255 enters the channel 183, the handle 120 can be rotated approximately 90° in either the clockwise or counter-clockwise direction until generally aligned with axis 125. The handle 120 can be rotated until the ridge 255 encounters the end of the channel 183. If the push button 115 is released, the action of springs 260 cause ridge 255 to travel up one of the outer slots of the stem 180. The handle 120 is then locked in a position that is rotated approximately 90° from its original position, which was generally aligned with axis 112.

Figure 5B:
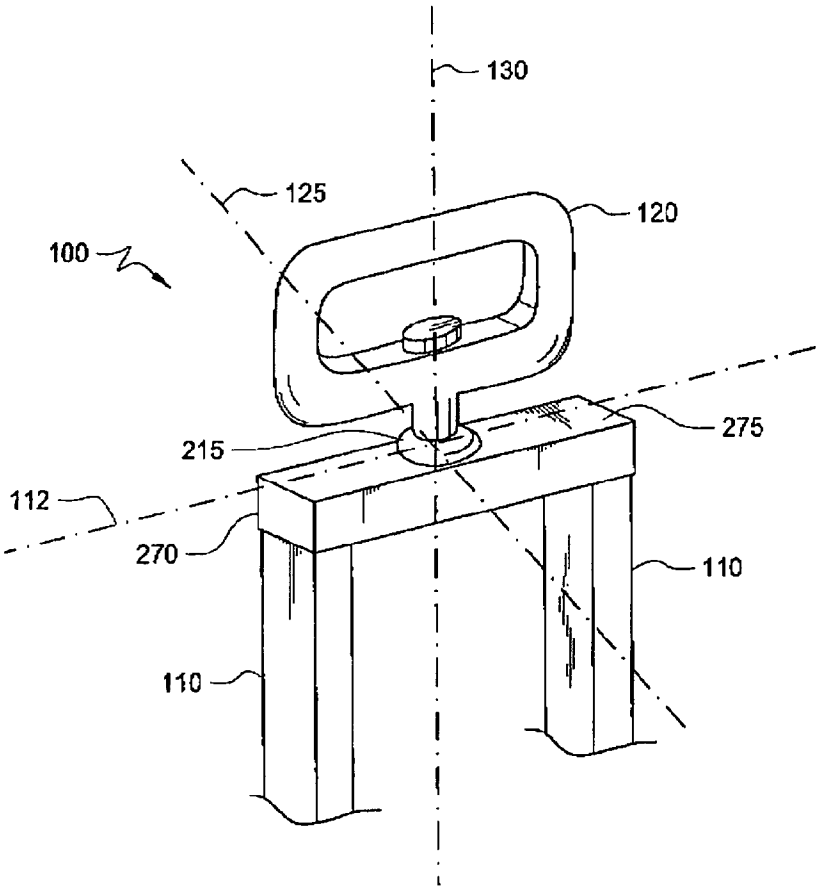
FIG. 5B is a perspective view illustrating another embodiment of the handle system in accordance with the inventive arrangements disclosed herein.

FIG. 5B is a perspective view illustrating another embodiment of the handle system 100 in accordance with the inventive arrangements disclosed herein. The embodiment of FIG. 5B illustrates the case where two telescoping members 110 have been included. An end cap 270 receives the ends of each telescoping member 110 that are distal from the luggage case. Notably, the shape of the telescoping members 110, can be rectangular, circular, oval, or the like. The shape of the telescoping members 110, however, is not intended to limit the scope of the present invention.

The end cap 270 further can serve as a casing which can securely hold the gear housing 205 therein. As depicted in FIG. 5B, portions of the gear housing 205 are hidden from view by the end cap 270. The components within, and/or which cooperatively engage, the gear housing 205 also can be included therein. The gear housing 205 can be positioned such that the collar 215 can extend through an aperture in the end cap 270 as shown. The collar ridge 212 can be located above the top portion 275 of the end cap 270, flush with the top portion 275, or beneath the top portion 275 such that the collar ridge is within the end cap 270. The particular configuration can vary according to design preference and the manner in which the gear housing 205 is secured to the end cap 270.

Rather than the spring 160 and spring housing 155 (not shown) being disposed in one of the telescoping tubes, these components can be disposed within the end cap 270. For example, the end cap 270 can be configured with an inner portion receptacle that can receive the spring 160 and/or spring housing 155 as needed. Accordingly, the components may be modified, i.e. shortened to fit within the end cap 270. Alternatively, or in combination, the end cap 270 can be large enough to accommodate the selected components of the handle system 100 described herein. Other mechanisms can be used, as may be required, for locking and unlocking the telescoping action of the telescoping members 110. As a result, the handle 120 can both pivot and rotate as described herein.

Figure 6:
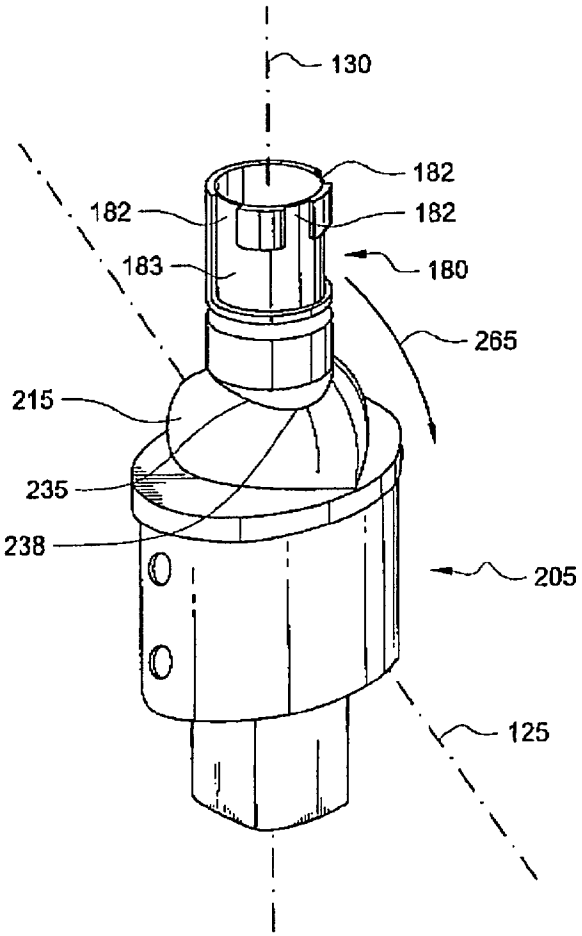
FIG. 6 is perspective view of the assembled gear case illustrated in FIG. 5A.

FIG. 6 is perspective view of the assembled gear housing 205 illustrated in FIG. 5A. As shown, the stem 180 of gear 165 extends beyond the collar 215 of the gear housing 205. The slots 182 and channel 183 are also shown. The spring housing 155 extends beyond the bottom portion of the gear housing 205. The slot 235 of the collar 215 is oblong having an extended portion 238 which allows the stem 180 to track or pivot in the direction indicated by arrow 265. Notably, the substantially flat portions 200 (not shown) of the gear base 170 when in contact with the substantially flat inner portions of the gear housing 205 shaft, also allow the gear 165 to pivot generally in the plane defined by axes 125 and 130.

The shape of the slot 235, however, prevents pivot motion in the reverse of direction 265 beyond a position that is generally aligned with axis 130.

Figure 7:
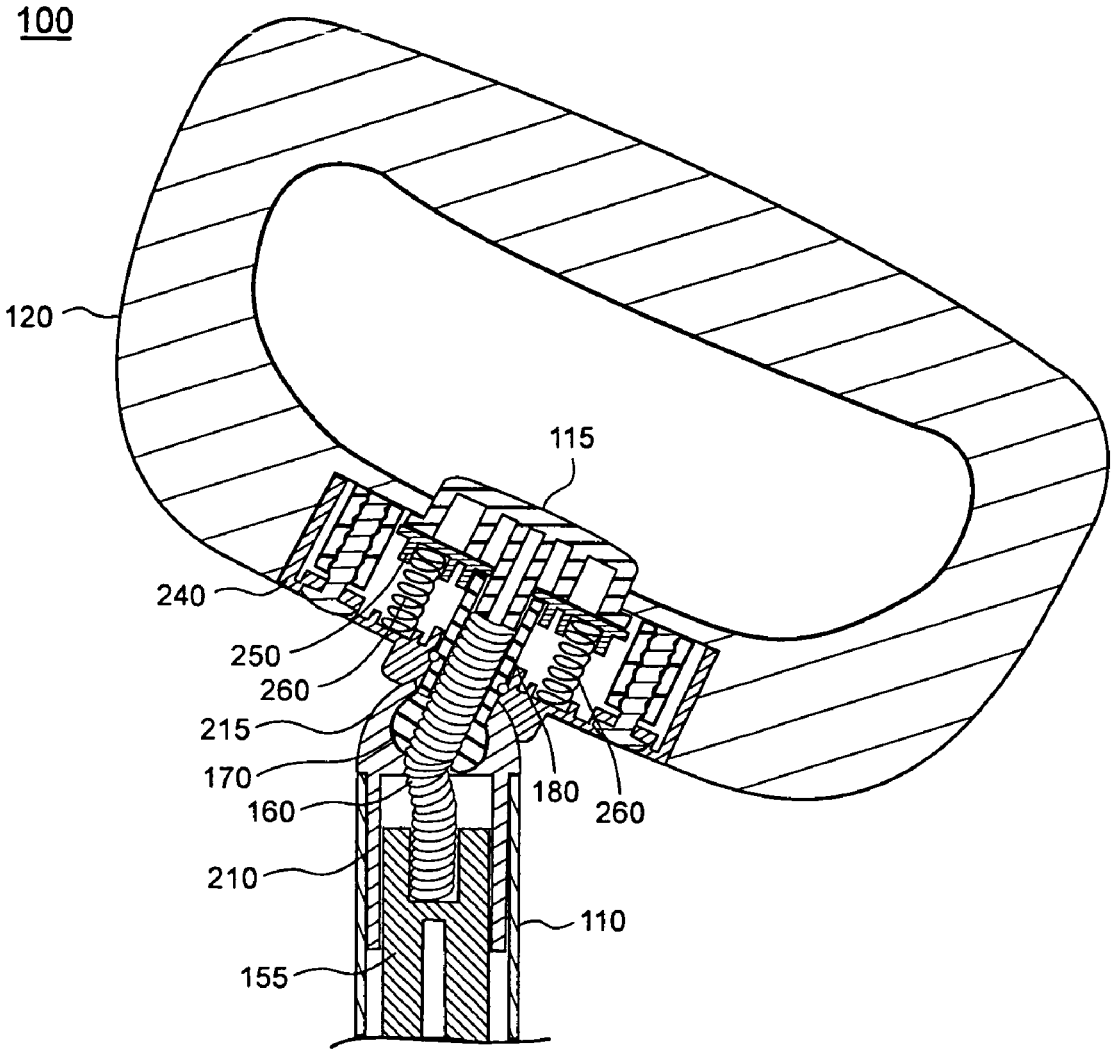
FIG. 7 is a section view of the handle system of FIG. 5A.

FIG. 7 is a section view of the handle system 100 In assembled form, the push button housing 240, the push button plate 250, and the springs 260 are disposed within the cavity of the handle 120. The stem 180 of the gear 165 also extends into this cavity. At least a portion of the spring housing 155 is disposed within, or engaged by, the cylindrical portion 210 of the gear housing 205. Both the spring housing 155 and the cylindrical portion 210 are located within the telescoping member 110. The collar 215 is located outside of the telescoping member 110. As discussed, the pivotal movement of the gear 165 is facilitated by the spherical gear base 170, which can be seen in a pivoted orientation. Accordingly, the handle 120 is able to both rotate and pivot about the end of the telescoping member 110 that is distal from the luggage case (not shown).

The operation of the handle 120 will now be described in more detail. In one embodiment, when the telescoping member 110 is in a retracted position, a first activation of button 115 releases a locking mechanism thereby causing the telescoping member 110 to extend only a portion of its fully extended length. This causes the handle 120 to rise automatically to an intermediate position that is slightly above a top face 108 of the luggage case 105. The handle 120 can be raised to this intermediate position to facilitate comfortable gripping by a user to allow the user to more easily extend the telescoping member 110 to its fully extended position. For example, the intermediate position can be located such that the top portion of the handle 120 is located approximately 1-2 inches above the top face 108 of the luggage case 105.

At full extension, the telescoping member 110 locks into place such that it cannot be retracted back into the luggage case 105 without activating button 115 again. The handle 120 also can be in a locked position such that rotational movement is restricted, but pivotal movement is permitted. By activating button 115 when the telescoping member 110 is fully extended, the handle 120 is released from its locked position. As such, the handle 120 can be rotated approximately 90° in either the clockwise or counter-clockwise direction.

At full rotation in either direction, the handle 120 again locks securely into place, such that the handle 120 cannot be rotated back to its initial position without further actuation of button 115. The pivotal movement of the handle 120, however, is operable in any position. Notably, if button 115 remains depressed, the user can extend the telescoping member 110 to its fully extended position as well as rotate the handle 120 approximately 90° from its original position in a single continuous movement.

To place the handle 120 back in its initial position and return the telescoping member 110 back to a retracted position within the luggage case 105, button 115 is actuated one or more times. Actuating and then releasing button 115 one time releases the handle 120, thereby allowing the handle to rotate back to its initial position. If desired, the telescoping member 110 can remain locked in the extended position with handle 120 also locked in its original position. The telescoping member 110 can be returned to its retracted position with another actuation of button 115. Alternatively, the handle 120 can be rotated back to its initial position and the telescoping member 110 can be returned to the retracted position in a single continuous movement by keeping button 115 depressed.

The various components described herein can be made from a variety of materials. In one embodiment, internal components of the handle system, the telescoping member, as well as the handle itself can be made of metals, alloys, composites, other suitable materials, or combinations thereof. This listing of materials is not intended to be comprehensive and is not intended to limit the scope of the present invention. Rather, any material which can be shaped as needed and which provides the necessary strength, rigidity, and other physical properties necessary can be used.

This invention can be embodied in other forms without departing from the spirit or essential attributes thereof. Accordingly, reference should be made to the following claims, rather than to the foregoing specification, as indicating the scope of the invention.

I claim:

1. A handle system for a rolling luggage case comprising:

a luggage case in which one or more articles can be stored for travel, said luggage case containing a top, bottom, front, and back panels, and a pair of sidewalls;

a wheel assembly provided at a location on said bottom panel and adjacent to said back panel;

at least one telescoping member that is extensible from a retracted position within said luggage case to an extended position protruding from said luggage case;

a gear assembly attached to an end of said at least one telescoping member that is distal from said luggage case, said gear assembly comprising at least a gear housing having a gear disposed therein that pivots within said gear housing, said gear assembly providing pivotal and rotational movement about said end of said at least one telescoping member said gear housing is comprised of a cylindrical portion, a domed portion, and a bore extending through a length of said gear housing, said domed portion having a slot through which a stem of said gear extends, said gear is comprised of a rounded base with two substantially flat portions, said substantially flat portions engaging substantially flat inner walls of said bore of said gear housing thereby facilitating pivotal movement of said gear along a plane that is substantially parallel with said substantially flat portions of said gear; and a handle attached to said at least one telescoping member through said gear assembly, wherein said handle is rotatable and pivotal about said end of said at least one telescoping member, said handle comprising a push button plate having a ridge, wherein said stem of said gear includes a plurality of slots joined by a channel that is substantially perpendicular to said plurality of slots, wherein said ridge rides within said plurality of slots and said channel thereby facilitating rotational motion of said handle.

2. A handle system for a rolling luggage case comprising:

a luggage case in which one or more articles can be stored for travel, said luggage case containing a top, bottom, front, and back panels, and a pair of sidewalls;

a wheel assembly provided at a location on said bottom panel and adjacent to said back panel;

at least one telescoping member that is extensible from a retracted position within said luggage case to an extended position protruding from said luggage case;

a gear assembly attached to an end of said at least one telescoping member that is distal from said luggage case, said gear assembly further comprising a gear comprising a stem; and a handle attached to said at least one telescoping member through said gear assembly, said handle comprising a push button plate having a ridge, wherein said stem of said gear includes a plurality of slots oriented along the length of said gear and joined by a channel that is substantially perpendicular to said plurality of slots;

wherein said ridge rides within said plurality of slots and said channel thereby facilitating rotational motion of said handle when said push button plate is depressed and facilitating the locking of said handle when said push button plate is released, said handle is rotatable and pivotal about said end of said at least one telescoping member.

3. The handle system of claim 2, said gear assembly comprising at least a gear housing having said gear disposed therein, said gear pivoting within said gear housing.

4. The handle system of claim 3, wherein said gear housing has a cylindrical portion, a domed portion, and a bore extending through a length of said gear housing, said domed portion having a slot through which a stem of said gear extends, said gear having a rounded base with two substantially flat portions, said substantially flat portions engaging substantially flat inner walls of the bore of said gear housing thereby facilitating pivotal movement of said gear along a plane that is substantially parallel with said substantially flat portions of said gear.

5. The handle system of claim 4, wherein a contour of the slot of said domed portion of said gear housing limits the pivotal movement of said gear in at least one direction.

6. The handle system of claim 4, wherein said rounded base of said gear has an aperture for receiving at least an end portion of a main spring, wherein an opposite portion of said main spring is cooperatively engaged by a spring housing disposed within said at least one telescoping member.

7. The handle system of claim 4, further comprising a push button housing having an aperture for receiving said stem.

8. The handle system of claim 7, wherein said gear includes a groove located between said stem and said rounded base, wherein said gear is secured within said push button housing by at least one pin that is approximately orthogonal to an orientation of said stem and which engages said groove.

9. The handle system of claim 2, wherein said plurality of slots includes a middle slot and two outer slots, each outer slot separated from said middle slot by approximately 90 degrees around a circumference of said stem.

10. The handle system of claim 9, wherein said handle rotates approximately 90 degrees in either a clockwise or a counter-clockwise direction about said end of said at least one telescoping member according to positions of said outer slots with respect to said middle slot.

11. The handle system of claim 2, wherein said handle pivots to form an angle defined by a first axis generally aligned with said at least one telescoping member and a second axis through a center of said handle, wherein said angle is within a range of approximately 0-45 degrees.

12. A handle system for an article of rolling luggage comprising:

a luggage case in which one or more articles can be stored for travel, said luggage case containing a top, bottom, front, and back panels, and a pair of sidewalls;

a wheel assembly provided at a location on said bottom panel and adjacent to said back panel;

at least one telescoping member mounted adjacent to said back panel, and extensible from a retracted position within said luggage case to an extended position protruding from said luggage case;

a gear assembly comprising a gear housing having a gear disposed therein whereby said gear pivots within said gear housing, said gear housing comprising a cylindrical portion, a domed portion, and a bore extending through a length of said gear housing, said domed portion having a slot through which a stem of said gear extends, said gear having a rounded base with two substantially flat portions, said substantially flat portions engaging substantially flat inner walls of the bore of said gear housing thereby facilitating pivotal movement of said gear in a plane that is substantially parallel with said substantially flat portions of said gear, wherein a contour of the slot of said domed portion of said gear housing limits the pivotal movement of said gear in at least one direction; and a handle secured to said at least one telescoping member by said gear assembly, said handle comprising a push button plate having a ridge, wherein said stem of said gear includes a plurality of slots joined by a channel that is substantially perpendicular to said plurality of slots, wherein said ridge rides within said plurality of slots and said channel thereby facilitating rotational motion of said handle;

wherein said gear assembly provides a limited range of movement of said handle relative to said at least one telescoping member, said movement comprising (1) rotational movement of said handle about a first axis generally aligned with said at least one telescoping member, and (2) pivotal movement defined by variation in a handle angle formed between the first axis and a second axis through a center of said handle that is substantially perpendicular to a gripping surface of said handle.

13. The handle system of claim 12, wherein a contour of the slot of said domed portion of said gear housing limits the pivotal movement of said gear in at least one direction.

14. The handle system of claim 12, wherein said plurality of slots includes a middle slot and two outer slots, each outer slot separated from said middle slot by approximately 90 degrees around a circumference of said stem.

15. The handle system of claim 14, wherein said handle rotates approximately 90 degrees in either a clockwise or a counter-clockwise direction about said at least one telescoping member according to positions of said outer slots with respect to said middle slot.

16. The handle system of claim 12, wherein said handle angle ranges from approximately 0-45 degrees.

17. The handle system of claim 12, wherein said rounded base of said gear has an aperture for receiving at least an end portion of a main spring, wherein an opposite portion of said main spring is cooperatively engaged by a spring housing disposed within said at least one telescoping member.

18. The handle system of claim 12, further comprising a push button housing having an aperture for receiving said stem.

19. The handle system of claim 18, wherein said gear includes a groove located between said stem and said rounded base, wherein said gear is secured within said push button housing by at least one pin that is approximately orthogonal to an orientation of said stem and which engages said groove.

* * * * *